US006321662B1

(12) United States Patent
Fraise

(10) Patent No.: US 6,321,662 B1
(45) Date of Patent: Nov. 27, 2001

(54) DINING TABLE ASSEMBLY

(76) Inventor: Ray A. Fraise, P.O. Box 57615, New Orleans, LA (US) 70157

( * ) Notice: Subject to any disclaimer, the term of this patent is extended or adjusted under 35 U.S.C. 154(b) by 0 days.

(21) Appl. No.: 09/546,299

(22) Filed: Apr. 10, 2000

(51) Int. Cl.[7] ..... A47B 33/00
(52) U.S. Cl. ..... 108/25; 108/26
(58) Field of Search ..... 108/25, 26; 248/165

(56) References Cited

U.S. PATENT DOCUMENTS

| | | | | |
|---|---|---|---|---|
| 1,568,154 | * | 1/1926 | Hannon et al. | 108/26 X |
| 1,579,823 | | 4/1926 | Langguth . | |
| 2,474,101 | | 6/1949 | Frothingham . | |
| 2,962,336 | | 11/1960 | Sudler . | |
| 3,111,095 | * | 11/1963 | Goodman | 108/26 X |
| 3,510,055 | | 5/1970 | Safford . | |
| 5,251,790 | | 10/1993 | Cohn et al. . | |
| 5,572,934 | * | 11/1996 | Aldridge et al. | 108/25 |
| 5,743,602 | | 4/1998 | Maddux et al. . | |
| 6,152,047 | * | 11/2000 | Mac Namara | 108/25 X |

* cited by examiner

*Primary Examiner*—Peter M. Cuomo
*Assistant Examiner*—Michael J. Fisher
(74) *Attorney, Agent, or Firm*—Joseph N. Breaux

(57) ABSTRACT

A table adapted for eating food items that generate large amounts of bones and shells. The table includes refuse discharge structures to allow large amounts of refuse to be disposed of without leaving the table. The table also includes structures that allow the top of the table to be configured for particular food items.

2 Claims, 3 Drawing Sheets

DINING TABLE ASSEMBLY

TECHNICAL FIELD

The present invention relates to dining tables and more particularly to a dining table assembly that includes a washer shaped outer table member, a circular shaped table member insert, a funnel shaped refuse guide member, a number of tray members, a number of flip-out refuse receiving chutes, and a number of condiment indentation covers; the washer shaped outer table member having a circular insert receiving aperture provided therethrough, a number of tray receiving opening provided therethrouqh, a number of cylinder shaped condiment indentation formed into a washer shaped table member top surface thereof, and a number of refuse receiving chute openings provided therethrough; each of the number of flip-out refuse receiving chutes having a flip-out portion pivotally mounted within one of the number of refuse receiving chute openings of the washer shaped outer table member and a tubular discharge end; the circular shaped table member insert being sized and shaped to sealingly fit into the circular insert receiving aperture such that a top circular table member surface is flush with the washer shaped table member top surface; the funnel shaped refuse guide member including a inwardly tapering collection portion in connection with a tubular shaped garbage can discharge tube at a bottom end and in connection with the tubular discharge ends of the number of flip out refuse receiving chutes; the inwardly tapering collection portion being installed in connection with the washer shaped outer table member such that the inwardly tapering collection portion is positioned below and concentric with the circular insert receiving aperture; the inwardly tapering collection portion funneling refuse received through the circular insert receiving aperture and the tubular discharge ends of the number of flip out refuse receiving chutes to the tubular shaped garbage can discharge tube; the tubular shaped garbage can discharge tube having a can discharge opening positionable above the top opening of a garbage can; each of the number of tray members having a first tray side and a second tray side; the first tray side having substantially planar along the entire area thereof; the second tray side defining a food retaining tray; each of the number of tray members being insertable into one of the number of tray receiving openings of the washer shaped outer table member such that when the first tray side is positioned upward within the tray receiving opening, the first tray side is flush with the washer shaped table member top surface and when the second tray side is positioned upward within the tray receiving opening the food retaining tray extends partially above the washer shaped table member top surface.

BACKGROUND ART

Many individuals enjoy having gatherings where large quantities of foods such as bar-b-que ribs, oysters on the half shell, boiled shrimp, boiled crawfish, boiled lobster and boiled crabs are consumed. As a result of consuming these types of food, large quantities of shells and bones are generated which must be periodically disposed of to make room for more. It would be a benefit, therefore, to have a table adapted for eating food items that generate large amounts of bones and shells, that included refuse discharge structures to allow large amounts of refuse to be disposed of without leaving the table and which also included structures that allowed the top of the table to be configured for particular food items.

GENERAL SUMMARY DISCUSSION OF INVENTION

It is thus an object of the invention to provide a dining table assembly that includes a washer shaped outer table member, a circular shaped table member insert, a funnel shaped refuse guide member, a number of tray members, a number of flip-out refuse receiving chutes, and a number of condiment indentation covers; the washer shaped outer table member having a circular insert receiving aperture provided therethrough, a number of tray receiving opening provided therethrough, a number of cylinder shaped condiment indentation formed into a washer shaped table member top surface thereof, and a number of refuse receiving chute openings provided therethrough; each of the number of flip-out refuse receiving chutes having a flip-out portion pivotally mounted within one of the number of refuse receiving chute openings of the washer shaped outer table member and a tubular discharge end; the circular shaped table member insert being sized and shaped to sealingly fit into the circular insert receiving aperture such that a top circular table member surface is flush with the washer shaped table member top surface; the funnel shaped refuse guide member including a inwardly tapering collection portion in connection with a tubular shaped garbage can discharge tube at a bottom end and in connection with the tubular discharge ends of the number of flip out refuse receiving chutes; the inwardly tapering collection portion being installed in connection with the washer shaped outer table member such that the inwardly tapering collection portion is positioned below and concentric with the circular insert receiving aperture; the inwardly tapering collection portion funneling refuse received through the circular insert receiving aperture and the tubular discharge ends of the number of flip out refuse receiving chutes to the tubular shaped garbage can discharge tube; the tubular shaped garbage can discharge tube having a can discharge opening positionable above the top opening of a garbage can; each of the number of tray members having a first tray side and a second tray side; the first tray side having substantially planar along the entire area thereof; the second tray side defining a food retaining tray; each of the number of tray members being insertable into one of the number of tray receiving openings of the washer shaped outer table member such that when the first tray side is positioned upward within the tray receiving opening, the first tray side is flush with the washer shaped table member top surface and when the second tray side is positioned upward within the tray receiving opening the food retaining tray extends partially above the washer shaped table member top surface.

Accordingly, a dining table assembly is provided. The dining table assembly includes a washer shaped outer table member, a circular shaped table member insert, a funnel shaped refuse guide member, a number of tray members, a number of flip-out refuse receiving chutes, and a number of condiment indentation covers; the washer shaped outer table member having a circular insert receiving aperture provided therethrough, a number of tray receiving opening provided therethrough, a number of cylinder shaped condiment indentation formed into a washer shaped table member top surface thereof, and a number of refuse receiving chute openings provided therethrough; each of the number of flip-out refuse receiving chutes having a flip-out portion pivotally mounted within one of the number of refuse receiving chute openings of the washer shaped outer table member and a tubular discharge end; the circular shaped table member insert being sized and shaped to sealingly fit into the circular insert receiving aperture such that a top circular table member surface is flush with the washer shaped table member top surface; the tunnel shaped refuse guide member including a inwardly tapering collection portion in connection with a tubular shaped garbage can discharge tube at a bottom end and in connection with the tubular discharge ends of the number of flip out refuse receiving chutes; the inwardly tapering collection portion being installed in connection with the washer shaped outer table member such that the inwardly tapering collection portion is positioned below and concentric with the circular insert receiving aperture; the inwardly tapering collection portion funneling refuse received through the circular insert receiving aperture and the tubular discharge ends of the number of flip out refuse receiving chutes to the tubular shaped garbage can discharge tube; the tubular shaped garbage can discharge tube having a can discharge opening positionable above the top opening of a garbage can; each of the number of tray members having a first tray side and a second tray side; the first tray side having substantially planar along the entire area thereof; the second tray side defining a food retaining tray; each of the number of tray members being insertable into one of the number of tray receiving openings of the washer shaped outer table member such that when the first tray side is positioned upward within the tray receiving opening, the first tray side is flush with the washer shaped table member top surface and when the second tray side is positioned upward within the tray receiving opening the food retaining tray extends partially above the washer shaped table member top surface.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
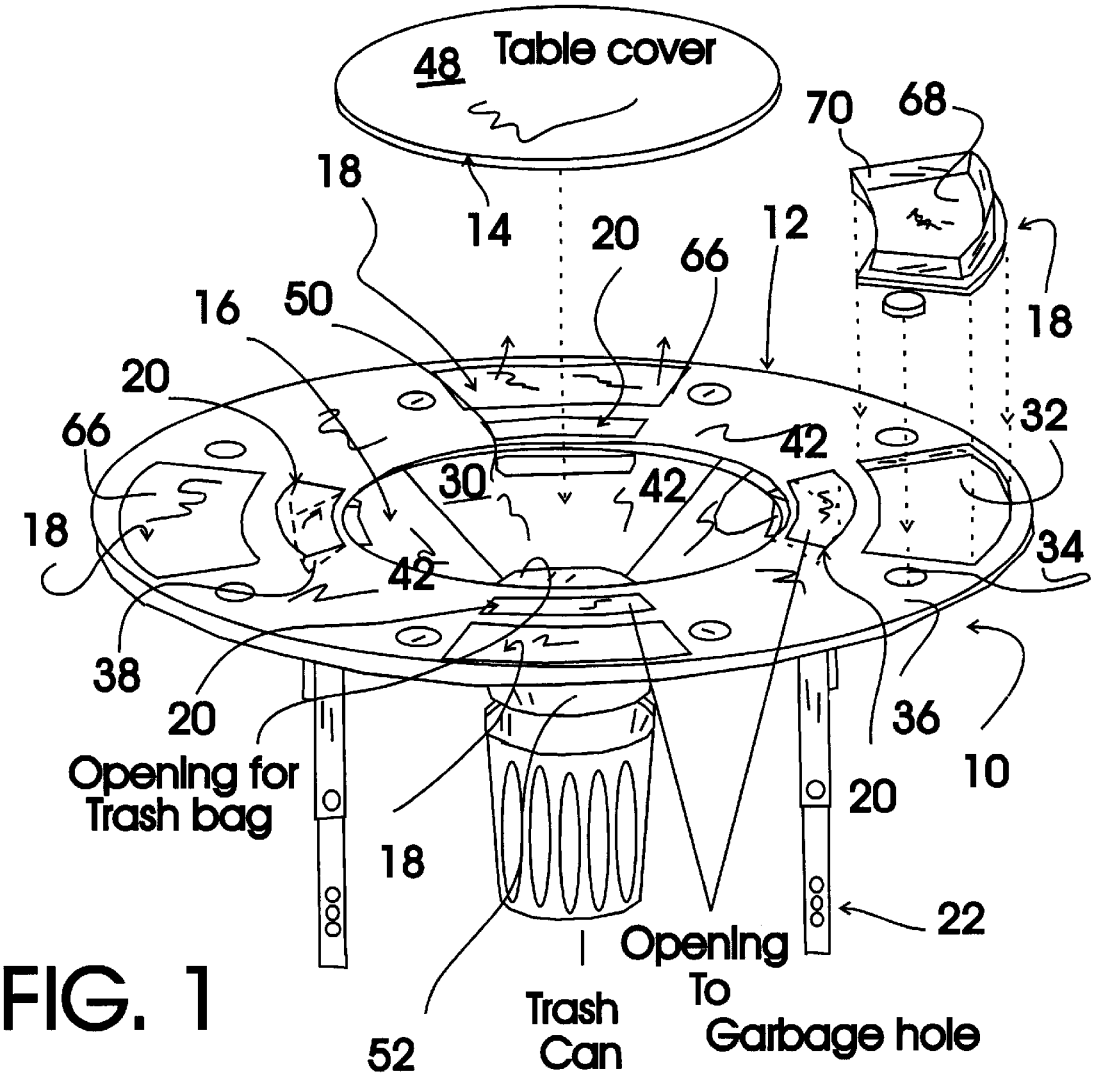
FIG. 1 is a partially exploded perspective view of an exemplary embodiment of the dining table assembly of the present invention showing the washer shaped outer table member, the circular shaped table member insert, the funnel shaped refuse guide member, a number of tray members, a number of flip-out refuse receiving chutes, a number of condiment indentation covers, and an optional height adjustable collapsible leg assembly; the washer shaped outer table member having a circular insert receiving aperture provided therethrough, a number of tray receiving opening provided therethrough, a number of cylinder shaped condiment indentation formed into a washer shaped table member top surface thereof, and a number of refuse receiving chute openings provided therethrough; each of the number of flip-out refuse receiving chutes having a flip-out portion pivotally mounted within one of the number of refuse receiving chute openings of the washer shaped outer table member and a Tubular discharge end; the circular shaped table member insert being sized and shaped to sealingly fit into the circular insert receiving aperture such that a top circular table member surface is flush with the washer shaped table member top surface; the funnel shaped refuse guide member including a inwardly tapering collection portion in connection with a tubular shaped garbage can discharge tube at a bottom end and in connection with the tubular discharge ends of the number of flip out refuse receiving chutes; the inwardly tapering collection portion being installed in connection with the washer shaped outer table member such that the inwardly tapering collection portion is positioned below and concentric with the circular Insert receiving aperture; the inwardly tapering collection portion funneling refuse received through the circular insert receiving aperture and the tubular discharge ends of the number of flip out refuse receiving chutes to the tubular shaped garbage can discharge tube; the tubular shaped garbage can discharge tube having a can discharge opening positionable above the top opening of a garbage can; each of the number of tray members having a first tray side and a second tray side; the first tray side having substantially planar along the entire area thereof; the second tray side defining a food retaining tray; each of the number of tray members being insertable into one of the number of tray receiving openings of the washer shaped outer table member such that when the first tray side is positioned upward within the tray receiving opening, the first tray side is flush with the washer shaped table member top surface and when the second tray side is positioned upward with In the tray receiving opening the food retaining tray extends partially above the washer shaped table member top surface; the optional height adjustable collapsible leg assembly being secured to a bottom surface of the washer shaped outer table member.
Figure 2:
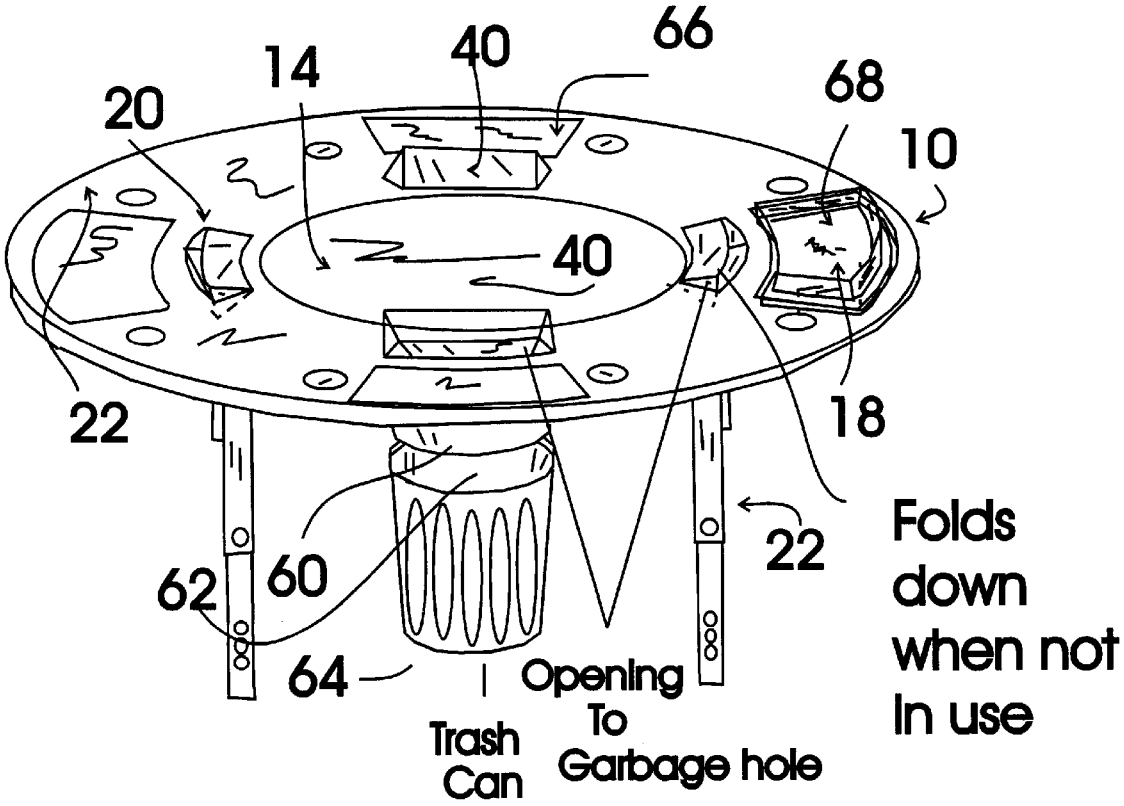
FIG. 2 is a second perspective view of the dining table assembly of FIG. 1.
Figure 3:
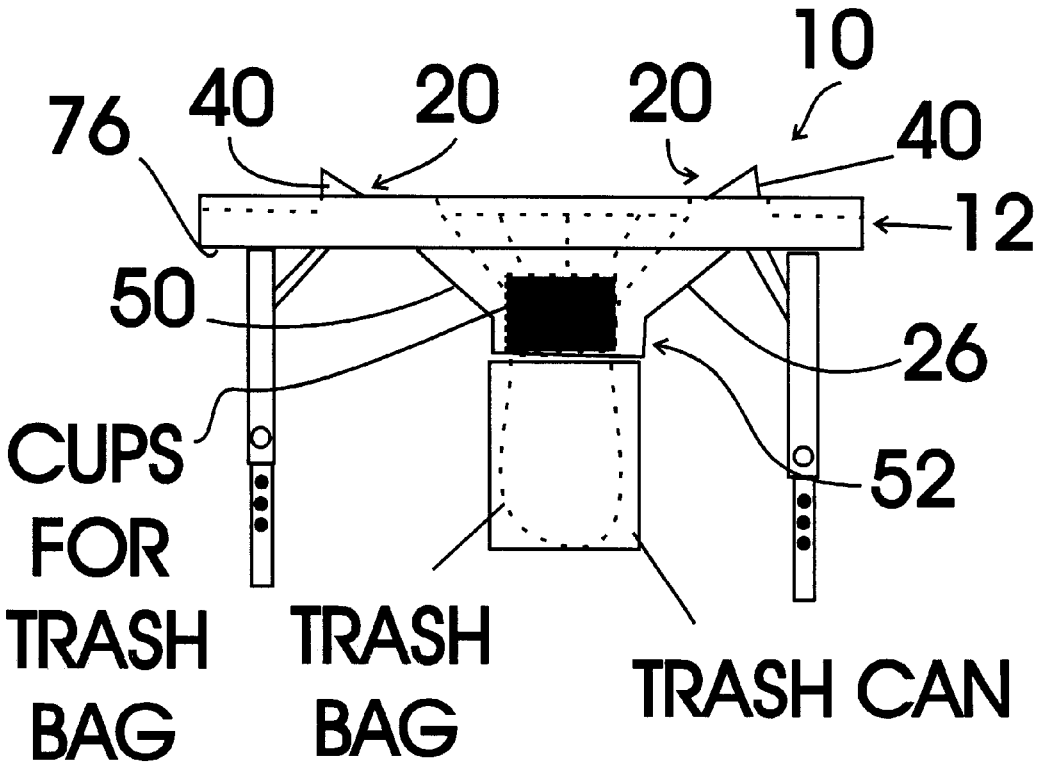
FIG. 3 is a side plan view of the dining table assembly of FIG. 1.

FIGS. 1–3 show various aspects of an exemplary embodiment of the dining table assembly of the present invention generally designated 10. Dining table assembly 10 includes a washer shaped outer table member, generally designated 12; a circular shaped table member insert, generally designated 14; a funnel shaped refuse guide member, generally designated 16; a number of tray members, generally designated 18; a number of flip-out refuse receiving chutes, generally designated 20; a number of condiment indentation covers, generally designated 22; and a height adjustable collapsible leg assembly, generally designated 24.

Washer shaped outer table member 12 has a circular insert receiving aperture 30 provided through the center thereof, a number of tray receiving opening 32 provided therethrough, a number of cylinder shaped condiment indentations 34 formed into a washer shaped table member top surface 36 thereof, and a number of refuse receiving chute openings 38 provided therethrough.

Each of the number of flip-out refuse receiving chutes 20 has a flip-out portion 40 pivotally mounted within one of the number of refuse receiving chute openings 38 of washer shaped outer table member 12 and a tubular discharge end 42. Circular shaped table member insert 14 is sized and shaped to sealingly fit into the circular Insert receiving aperture 30 such that a top circular table member surface 48 is flush with the washer shaped table member top surface 36.

Funnel shaped refuse guide member 16 includes an inwardly tapering collection portion 50 in connection with a tubular shaped garbage can discharge tube 52 at a bottom end and in connection with the tubular discharge ends 42 of the number of flip out refuse receiving chutes 20. Inwardly tapering collection portion 50 is installed in connection with the washer shaped outer table member 12 such that the inwardly tapering collection portion 50 is positioned below and concentric with the circular insert receiving aperture 30. Inwardly tapering collection portion 50 funnels refuse received through the circular insert receiving aperture 30 and the tubular discharge ends 42 of the number of flip out refuse receiving chutes 20 to the tubular shaped garbage can discharge tube 32. Tubular shaped garbage can discharge tube 52 has a can discharge opening 60 positionable above a top opening 62 of a garbage can 64.

Each of the number of tray members 18 has a first tray side 66 and a second tray side 68. First tray side 66 is substantially planar along the entire area thereof. Second tray side 68 defines a food retaining tray 70. Each of the number of tray members 18 is insertable into one of the number of tray receiving openings 32 of the washer shaped outer table member 12 such that when the first tray side 66 is positioned upward within tray receiving opening 32, the first tray side 66 is flush with washer shaped table member top surface 36 and when the second tray side 68 is positioned upward within the tray receiving opening 32 the food retaining tray 70 extends partially above washer shaped table member top surface 36. Height adjustable collapsible log assembly 22 is secured to a bottom surface 76 of washer shaped outer table member 12.

It can be seen from the preceding description that a dining table assembly has been provided.

It is noted that the embodiment of the dining table assembly described herein in detail for exemplary purposes is of course subject to many different variations in structure, design, application and methodology. Because many varying and different embodiments may be made within the scope of the inventive concept(s) herein taught, and because many modifications may be made in the embodiment herein de-tailed in accordance with the descriptive requirements of the law, it is to be understood that the details herein are to be interpreted as illustrative and not in a limiting sense.

What is claimed is:

1. A dining table assembly comprising:

a washer shaped outer table member;

a circular shaped table member insert;

a funnel shaped refuse guide member;

a number of tray members;

a number of flip-out refuse receiving chutes; and a number of condiment indentation covers;

said washer shaped outer table member having a circular insert receiving aperture provided therethrough, a number of tray receiving openings provided therethrough, a number of cylinder shaped condiment indentations formed into a washer shaped table member top surface thereof, and a number of refuse receiving chute openings provided therethrough;

each of said number of flip-out refuse receiving chutes having a flip-out portion pivotally mounted within one of said number of refuse receiving chute openings of said washer shaped outer table member and a tubular discharge end;

said circular shaped table member insert being sized and shaped to sealingly fit into said circular insert receiving aperture such that a top circular table member surface is flush with said washer shaped table member top surface;

said funnel shaped refuse guide member including a inwardly tapering collection portion in connection with a tubular shaped garbage can discharge tube at a bottom end and in connection with said tubular discharge ends of said number of flip out refuse receiving chutes;

said inwardly tapering collection portion being installed in connection with said washer shaped outer table member such that said inwardly tapering collection portion is positioned below and concentric with said circular insert receiving aperture;

said inwardly tapering collection portion funneling refuse received through said circular insert receiving aperture and said tubular discharge ends of said number of flip out refuse receiving chutes to said tubular shaped garbage can discharge tube;

said tubular shaped garbage can discharge tube having a can discharge opening positionable above said top opening of a garbage can;

each of said number of tray members having a first tray side and a second tray side;

said first tray side having substantially planar along said entire area thereof;

said second tray side defining a food retaining tray;

each of said number of tray members being insertable into one of said number of tray receiving openings of said washer shaped outer table member such that when said first tray side is positioned upward within said tray receiving opening, said first tray side is flush with said washer shaped table member top surface and when said second tray side is positioned upward within said tray receiving opening said food retaining tray extends partially above said washer shaped table member top surface.

2. The dining table assembly of claim 1 further comprising:

a height adjustable collapsible leg assembly secured to a bottom surface of said washer shaped outer table member.

* * * * *